US009498732B2

(12) United States Patent
Burke

(10) Patent No.: US 9,498,732 B2
(45) Date of Patent: Nov. 22, 2016

(54) MODEL RAILWAY AESTHETIC INSERT

(71) Applicant: Brian M. Burke, Ft. Wayne, IN (US)

(72) Inventor: Brian M. Burke, Ft. Wayne, IN (US)

( * ) Notice: Subject to any disclaimer, the term of this patent is extended or adjusted under 35 U.S.C. 154(b) by 231 days.

(21) Appl. No.: 14/567,359

(22) Filed: Dec. 11, 2014

(65) Prior Publication Data

US 2016/0166944 A1 Jun. 16, 2016

(51) Int. Cl.

| | |
|---|---|
| ***A63H 18/00*** | (2006.01) |
| ***A63H 18/02*** | (2006.01) |
| ***E01B 23/00*** | (2006.01) |
| ***E01B 25/00*** | (2006.01) |

(52) U.S. Cl.

CPC ..... *A63H 18/02* (2013.01); *E01B 23/00* (2013.01); *E01B 25/00* (2013.01)

(58) Field of Classification Search

CPC ..... A63H 18/00; A63H 18/02; A63H 19/30; E01B 23/00; E01B 23/14; E01B 25/00; E01B 25/02; E01B 25/04

See application file for complete search history.

(56) References Cited

U.S. PATENT DOCUMENTS

| | | | | | |
|---|---|---|---|---|---|
| 2,272,903 | A * | 2/1942 | Bonanno | A63H 19/32 | 238/10 C |
| 2,764,357 | A | 9/1956 | Katryniak | | |
| 3,074,647 | A | 1/1963 | Bonanno | | |
| 3,650,468 | A * | 3/1972 | Ewe | A63H 19/30 | 238/10 A |
| 4,225,081 | A | 9/1980 | Ikegame | | |
| 4,898,326 | A | 2/1990 | Edwards et al. | | |
| 4,951,872 | A * | 8/1990 | Sheffield | A63H 19/30 | 238/10 E |
| 5,503,330 | A * | 4/1996 | Riley | A63H 19/36 | 238/10 B |
| 5,529,241 | A * | 6/1996 | Roder | A63H 19/30 | 238/10 E |
| 5,690,278 | A * | 11/1997 | Grubb | A63H 19/30 | 238/10 E |
| 6,019,289 | A * | 2/2000 | Sung | A63H 19/30 | 104/DIG. 1 |
| 2016/0166944 | A1* | 6/2016 | Burke | A63H 18/02 | 238/10 E |

OTHER PUBLICATIONS

Willis, Lee, "Started my Streets Country Road", http://ogrforum.ogaugerr.com/topic/started-my-streets-country-road, Jan. 27, 2013 (Basswood track insert depiction).

* cited by examiner

*Primary Examiner* — Jason C Smith

(57) ABSTRACT

An aesthetic insert adapted to be received between a wheel-bearing rail and the center rail of extant model railroad track, and in its installed position at least partially covers or hides the side of the center rail, camouflaging it and rendering it less noticeable. The installed insert superposes portions of and simulates the presence and/or appearance of a crosstie surface. The insert may be a separately installable, individual element, or a plurality of interconnected individual elements installable as a group and interconnected by one or more connecting members.

20 Claims, 12 Drawing Sheets

MODEL RAILWAY AESTHETIC INSERT

BACKGROUND

The present invention relates to model railroading, and particularly to improving the realistic appearance of model railroad track, and more particularly to track having a center rail.

Realism in the appearance of trains and track, and the buildings, accessories, and other elements of attendant layout scenery, is a quality many model railroading hobbyists continually strive to achieve. One area of continuing frustration for these enthusiasts concerns the presence in certain types of model railroad track of its electrified rail which is centrally located between the two parallel wheel-bearing rails. Typically, this center rail is electrified by alternating current (AC) to provide electrical power to the train locomotive, which is typically powered by an AC or rectified direct current (DC) electric motor grounded through its wheels to the wheel-bearing rails of the track, which are also grounded. A center rail is generally not included in real-world track for nonelectric trains, and therefore provides what many consider an undesirable characteristic of certain types of model railroad track that detracts from its realism. It has long been desirable, therefore, to mask or camouflage the electrified center rail, while preserving its functional purpose of powering the locomotive.

One type of model railroading track utilizing an electrified center rail is O-gauge track, which has long been widely used. Certain example sections of O-gauge track still commonly used in model railroading layouts are shown in FIGS. 1-3, although it is to be understood that the present disclosure does not relate solely to examples depicted herein or to O-gauge track, but to any type of model railroad track whose appearance is beneficially altered by application of the present invention. Extant railroad track which includes a center rail is generally described as follows, with reference to FIGS. 1-4.

Herein, outward and inward generally refer to directions away from and towards the center rail, respectively. Extant track 20 include a pair of elongate wheel-bearing rails 22 each having inwardly facing lateral side 24, an opposing, outwardly facing lateral side 26, and a top surface 28 along which the train wheels roll. The top surface 28 may be defined on head 30 of the respective rail 22. Opposite the head 30, each rail 22 may be provided with base 32 on which the rail 22 appears to rest. Rail 22 may define a web 34 that extends vertically between head 30 and base 32, providing rail 22 with a generally I-shaped cross-sectional shape. Typically, rail inward and outward lateral sides 24, 26 are defined by web 34 and portions of head 30. In some track embodiments, base 32 is planar and substantially horizontal, and simulates having a bottom surface resting upon a plurality of simulated tie plates 36. In such embodiments the rail base 32 and tie plates 36 may appear to be affixed by track spikes 38 to top surface 40 of one of a plurality of crossties 42.

Crossties 42, which may, for example, be molded plastic or shaped wood, are elongate and in some track embodiments simulate in color and texture the appearance of the wooden crossties they are intended to replicate. In the depicted track embodiments, each crosstie 42 extends between opposing axially opposite ends 44, 46 which are planar, and have opposing, planar first and second side surfaces 48, 50 facing directions along which rails 22 extend. First side surface 48 and second side surface 50 of adjacent crossties 42 interface each other and are spaced along rails 22. In the depicted track embodiments, opposite crosstie top surfaces 40 is planar bottom surface 52 which may or may not fully extend between crosstie first and second side surfaces 48, 50, depending on the crosstie material or forming method. Each depicted crosstie 42 has central axis 54 that extends between and is normal to opposing axially opposite ends 44, 46. In straight track sections 20, central axes 54 are parallel; in curved track sections 20 central axes 54 converge in a radial direction toward the inside of the curve and diverge in the opposite radial direction, toward the outside of the curve.

Extant track sections 20 include a singular, elongate electrified rail 60 centrally disposed between the pair of wheel-bearing rails 22. Because center rail 60 is electrified, it must be electrically isolated from wheel-bearing rails 22, and may be electrically insulated from crossties 42 (and thus from rails 22), or may be electrically isolated from rails 22 by virtue of crossties 42 themselves being electrically insulative. For example, crossties 42 may be formed of a dielectric material such as plastic or wood as described above.

Center rail 60 has opposing lateral sides 62 that interface inward lateral sides 24 of rails 22. Center rail 60 has top surface 64 that may or may not, depending on manufacturer, be defined on a head 66 (similar to head 30) of the respective rail 60. When viewed in cross-sections taken perpendicular to the longitudinal axes of rails 22 and 60, center rail top surface 64 and wheel-bearing rail top surfaces 28 define a generally horizontal plane. Typically, top surfaces 28 and 64 are located at a common height above horizontal top planar surface 40 of crossties 42 in most extant track 20 embodiments. In certain extant track embodiments, center rail 60 may also be provided with a base 68 (similar to base 32), and lateral sides 62 that are defined by a web 70 (similar to web 34) extending vertically between head 66 and base 68, to define a generally I-shaped cross-sectional shape. In certain embodiments, base 68 is substantially horizontal, and simulates having a bottom surface resting upon a plurality of simulated tie plates 72 (similar to tie plates 36). Alternatively, at each crosstie 42 base 68 may be hidden beneath crosstie top surface 40. Typically, surface 40 is planar and horizontal, a configuration that accentuates the presence of the upstanding center rail 60, as discussed further below.

FIG. 1 shows a straight section of extant O-gauge track 20*a* of a brand commercialized by Atlas Model Railroad Co., Inc. that has wheel-bearing rails 22*a*, molded, brown plastic crossties 42*a* having a hollowed bottom surface 52, and center rail 60*a*. In track section 20*a*, rails 22*a* and 60*a* each have head 30, 66 and base 32, 68 between which extends web 34, 70. The cross-sections of rails 22*a* and 60*a* are solid, and the size of and/or spacing between crossties 42*a* are unique to that particular brand and size (e.g., O-gauge) of track.

FIG. 2 shows a straight section of extant O-gauge track 20*b* of a brand commercialized by M.T.H. Electric Trains that has wheel-bearing rails 22*b*, molded, brown plastic crossties 42*b* having a hollowed bottom surface 52, and center rail 60*b*. In track section 20*b*, rails 22*b* each have a solid cross-section, and head 30 and base 32 between which extends web 34. The cross-section of rail 60*b* is also solid, but has uniformly rectangular vertical and horizontal portions; the vertical portion, which defines opposing lateral sides 62, is bereft of a head portion, and perpendicularly intersects the upper surface of the horizontal rail portion which defines base 68, thereby defining an inverted T shape. Each crosstie 42*b* is molded about base 68, thereby defining in each crosstie a horizontal slot 74 containing base 68, and vertical slot 76 in crosstie top surface 40 from which the vertical portion of center rail 60*b*. The size of and/or spacing between crossties 42*b* are unique to that particular brand and size (e.g., O-gauge) of track.

FIG. 3 shows a straight section of extant O-gauge track 20*c* of a brand commercialized by GarGraves Trackage Corporation that has wheel-bearing rails 22*c*, wooden, brown-stained crossties 42*c*, and center rail 60*c*. In track section 20*c*, rails 22*c* and 60*c* each have head 30, 66 and base 32, 68 between which extends web 34, 70. Rails 22*c* and 60*c* are formed of sheet metal and generally tubular, providing hollow cross-sections. Crossties 42*c* are provided with angled slots 56 into which flanges of rails 22*c* are fitted and angled slots 78 into which flanges of rail 60*c* are fitted, as shown. The size of and/or spacing between crossties 42*c* are unique to that particular brand and size (e.g., O-gauge) of track.

In track 20*a*, 20*b* and 20*c*, center rail 60 is camouflaged and rendered somewhat less noticeable by its having a dark color, whereas rails 22 are relatively lighter in color. For example, center rail 60 may be black or a dark brown color similar to that of crossties 42, whereas wheel-bearing rails 22 may be a color such as silver, brass, or gray providing greater contrast to the brown crossties.

FIG. 4 shows a straight section of prior O-gauge track 20*d* commercialized by Lionel Corporation as Super "O"™ model railroad track. In track 20*d*, wheel-bearing rails 22*d* each have head 30 and base 32 between which extends web 34. Rails 22*d* are formed of sheet metal and generally tubular, providing a hollow cross-section. Rail 60*d* has a substantially uniform rectangular cross-section and is darkly colored, as described above. Each crosstie 42*d* is molded, brown plastic and provided with a vertical slot 80 into which the bottom portion of center rail 60*d* is disposed. Unlike track 20*a*, 20*b* and 20*c*, in track 20*d* the entire top surface 40 of crosstie 42*d* is not substantially horizontal between crosstie opposite axial ends 44, 46. In track 20*d*, each crosstie 42*d* has a planar portion of its top surface 40 that inclines from a location laterally inward of each rail 22*d* towards the interfacing side 62 of center rail 60*d*. Thus, in track 20*d* laterally inward portions of crosstie 42*d*, which are located adjacent center rail lateral sides 62, cover and hide from view portions of center rail lateral sides 62, rendering center rail 60*d* less noticeable than it would be were the entirety of crosstie surface 40 to define a horizonal plane, as it does in track 20*a*, 20*b* and 20*c*.

Another popular but unshown example of extant track is an embodiment commercialized by Lionel Corporation and commonly known as Lionel tubular track, which is widely available in O-gauge. This type of track employs metal stampings as crossties. These crossties have horizontally planar top surfaces and open axial ends, are typically painted black, and are widely spaced along the length of each track section. In such track the wheel-bearing and center rails are bright silver and their bases are clamped via staking to the crossties, with the center rail insulated from each crosstie with a sheet of insulating material wrapped about the center rail base and a portion of the rail web. Comparatively, the appearance of Lionel tubular track is far less realistic than that of any of above-described track 20*a*, 20*b*, 20*c* and 20*d*.

Prior track 20*a*, 20*b*, 20*c* and 20*d* represent the current state of the art with regard to camouflaging center rail 60, with track 20*d*, by virtue of its uniquely shaped crossties 42*d* which incline laterally inwardly towards the lateral sides 62 of center rail 60*d*, generally considered to be the best existing approach towards rendering the center rail less noticeable and therefore imparting the most realistic appearance to the track.

There is, however, a substantial amount of extant track that is and will remain in use. Improving the aesthetics of model railroad layouts that utilize existing track having a center rail and crossties provided with top surfaces that substantially lie in horizontal planes between its wheel-bearing rails and the center rail, by at least partially covering or hiding the side of the center rail without compromising function, is desirable.

SUMMARY

The present disclosure provides an aesthetic insert adapted to be received between a wheel-bearing rail and the center rail of extant model railroad track. Herein, either of the two wheel-bearing rails of an extant track section may also be referred to as a first rail, or its center rail may also be referred to as a second rail. An installed insert superposes a crosstie portion(s) located between the first and second rails, and simulates the presence and/or appearance of a track crosstie portion(s). In its installed position, an insert according to the present disclosure at least partially covers or hides one lateral side of the (second or) center rail, thereby camouflaging the center rail and rendering it less noticeable. The insert may be a separately installable, individual element, or a plurality of interconnected individual elements installable as a group and interconnected by one or more connecting members.

The present disclosure provides an aesthetic insert for use with extant model railroad track having spaced, elongate and parallel first and second rails each having a top surface and mutually interfacing sides. The extant model railroad track also has a plurality of spaced crossties extending between and at least partially located beneath the attached first and second rails, each of the plurality of crossties having a top surface located between the first and second rails. The sides of the first and second rails have a substantially common height from the top surface of the crosstie to the respective top surfaces of the first and second rails. The insert has an installed position relative to the extant model railroad track between the first and second rails. The insert includes an insert element defined by an upper portion adapted to superpose at least a portion of the top surface of a crosstie. The upper portion has an upper surface adapted to simulate the presence and/or appearance of a surface of a crosstie. The upper portion defines an outer edge located proximate the side of the first rail at a first distance below the top surface of the first rail in the installed position. The upper portion defines an inner edge located proximate the side of the second rail at a second distance below the top surface of the second rail in the installed position, and the first distance is substantially greater than the second distance, whereby the side of the second rail is partially hidden from view by the insert in the installed position.

A further aspect of the present disclosure is that the outer and inner edges are substantially parallel.

A further aspect of the present disclosure is that, in the installed position, the second distance is substantially less than a third distance to the inner edge above the top surface of the crosstie superposed by the upper portion.

A further aspect of the present disclosure is that the upper portion upper surface is substantially planar.

A further aspect of the present disclosure is that the insert also includes spaced first and second side portions depending from the upper portion, and the side portions are adapted to at least partially enclose a space located between the upper portion and the top surface of the crosstie superposed by the upper portion in the installed position.

According to another aspect of the present disclosure, the first and second side portions and the upper portion are integrally-formed of molded dielectric material.

According to another aspect of the present disclosure, the first and second side portions are adapted to superpose portions of opposing surfaces of a crosstie in the installed position.

According to another aspect of the present disclosure, the first and second side portions are substantially planar.

According to another aspect of the present disclosure, the first and second side portions define a pair of opposing exterior side surfaces each adapted to simulate the appearance of a surface of a crosstie.

A further aspect of the present disclosure is that the insert includes an interconnected plurality of insert elements, each insert element having an upper portion adapted to superpose a different one of the plurality of crossties in the installed position.

According to another aspect of the present disclosure, the plurality of insert elements is interconnected proximate the side of the second rail in the installed position.

According to another aspect of the present disclosure, the insert includes a connecting member extending between two insert elements, with the connecting member disposed proximate the inner edges of the respective insert elements and extending along the side of the second rail in the installed position.

An additional aspect of the disclosure is that the connection member is flexible and the two insert elements are adapted to have different orientations relative to each other in the installed position.

According to another aspect of the present disclosure, each upper portion is elongate and is bisected by a plane extending between the respective outer and inner edges, with each insert element substantially symmetrical about the respective plane thereof.

An additional aspect of the disclosure is that the insert is adapted to be received between the first and second rails of a section of extant model railroad track and, relative to a received insert in the installed position, the planes of an adjacent pair of respective insert elements are substantially parallel along a straight section of the extant model railroad track, and/or converge in a direction from the respective outer edges to the respective inner edges along a curved section of the extant model railroad track whose first rail defines an outside curve, and/or diverge in a direction from the respective outer edges to the respective inner edges along a curved section of the extant model railroad track whose first rail defines an inside curve.

A further aspect of the present disclosure is that the insert is adapted to retentively engage at least one surface of a superposed crosstie in the installed position.

A further aspect of the present disclosure is that the insert is adapted to retentively engage opposing surfaces of a superposed crosstie in the installed position.

A further aspect of the present disclosure is that the insert is adapted to retentively engage a bottom surface of a superposed crosstie in the installed position.

According to another aspect of the present disclosure, the insert element includes spaced first and second side portions depending from the upper portion, with the first and second side portions adapted to superpose portions of opposing surfaces of a crosstie in the installed position. The first and second side portions are provided with lips adapted to superpose a bottom surface of a superposed crosstie in the installed position.

A further aspect of the present disclosure is that the insert is adapted to retentively engage at least one of the first and second rails in the installed position.

BRIEF DESCRIPTION OF THE DRAWINGS

The above-mentioned aspects and other characteristics and advantages of an apparatus and/or method according to the present disclosure will become more apparent and will be better understood by reference to the following description of exemplary embodiments taken in conjunction with the accompanying drawings, wherein.

Figure 1:
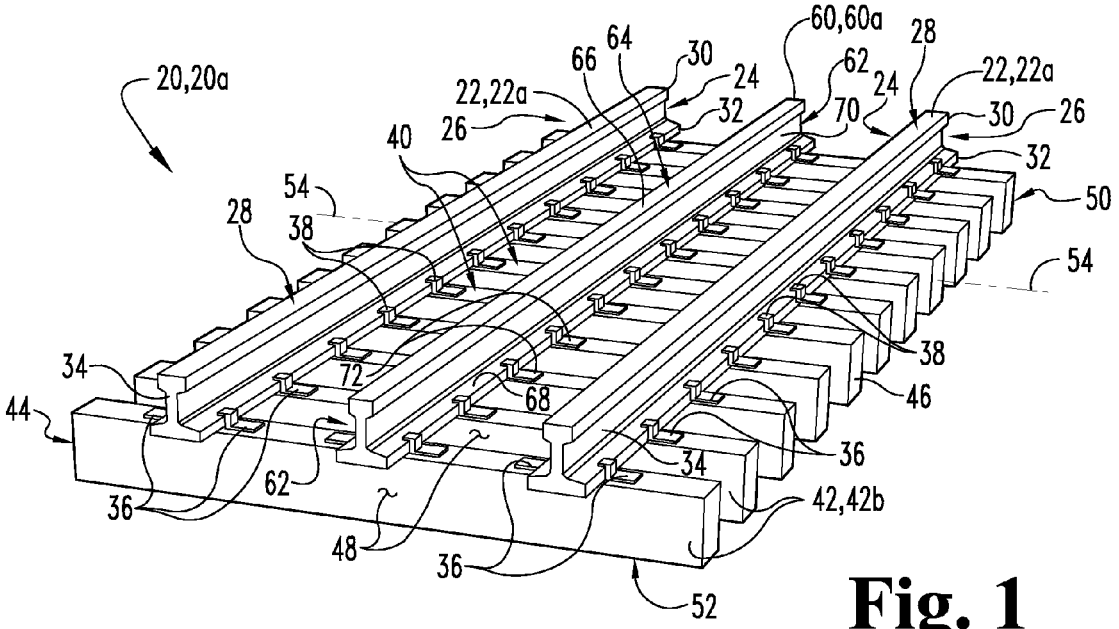
Fig. 1 (Prior Art)
FIG. 1 is a perspective view of a section of extant O-gauge model railroad track commercialized by Atlas Model Railroad Co., Inc.
Figure 2:
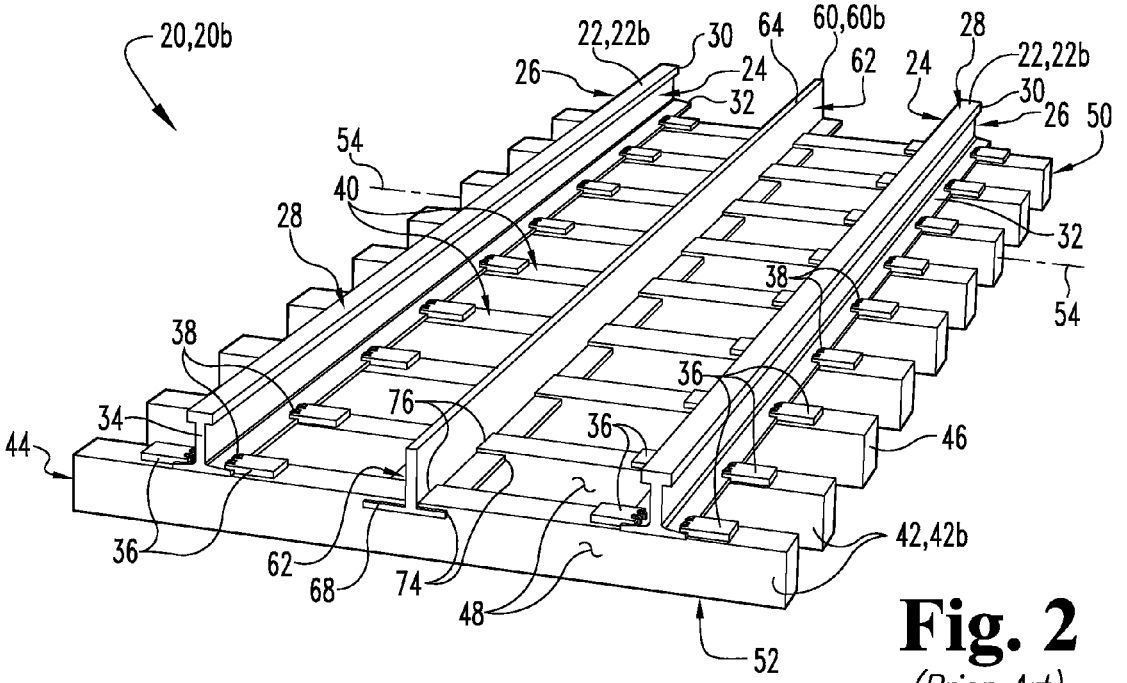
Fig. 2 (Prior Art)
FIG. 2 is a perspective view of a section of extant O-gauge model railroad track commercialized by M.T.H. Electric Trains.
Figure 3:
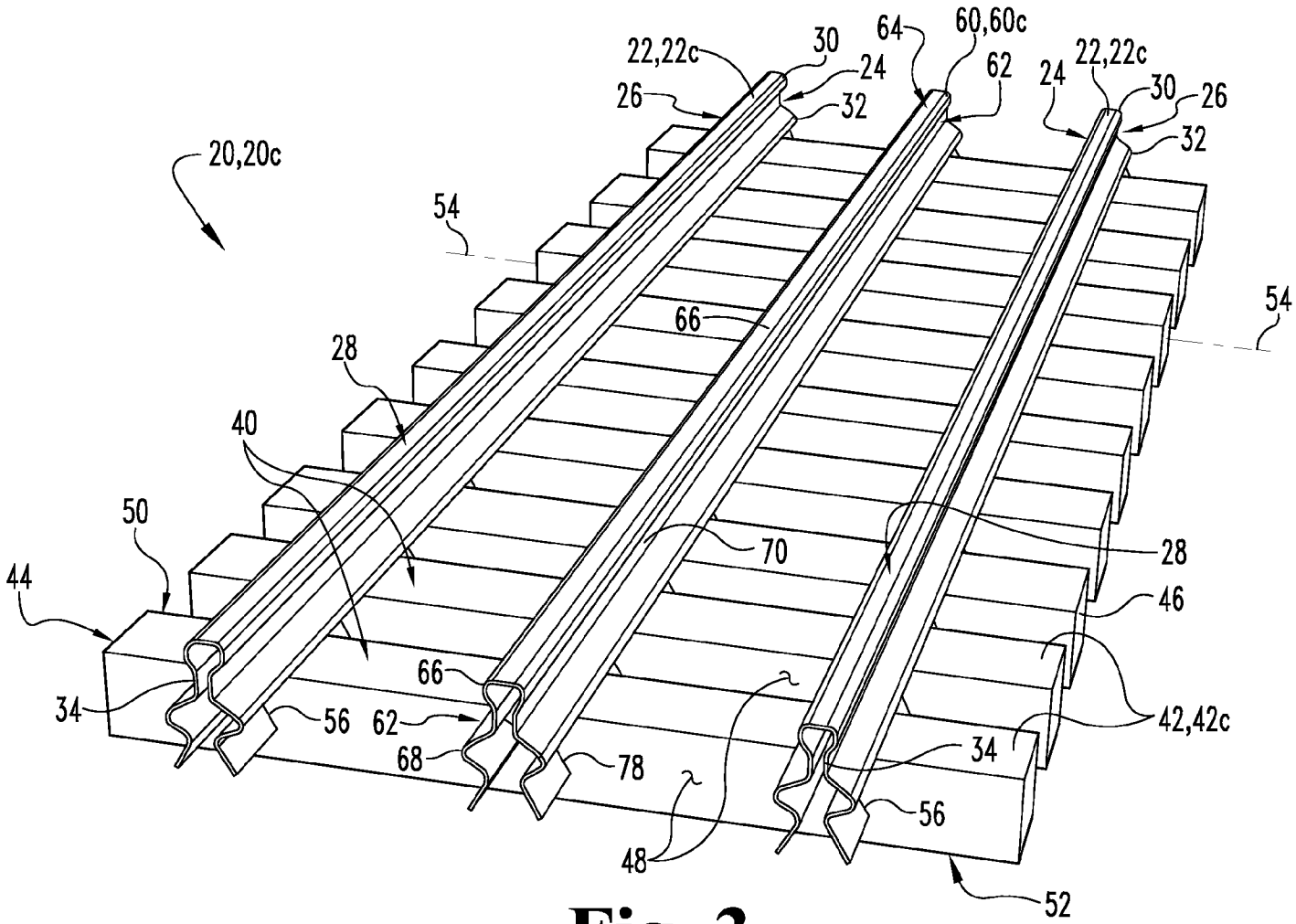
Fig. 3 (Prior Art)
FIG. 3 is a perspective view of a section of extant O-gauge model railroad track commercialized by GarGraves Trackage Corporation.
Figure 4:
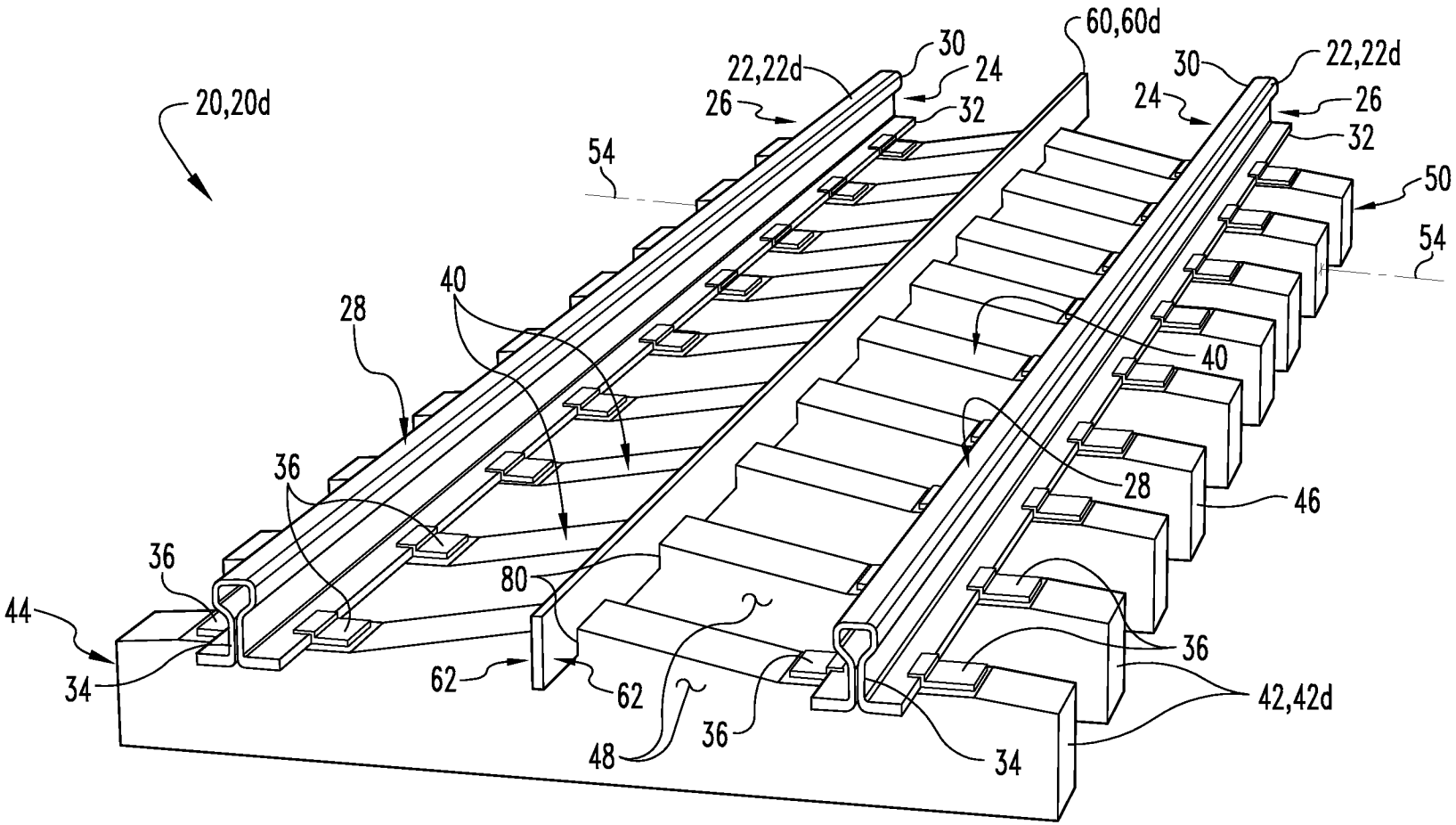
Fig. 4 (Prior Art)
FIG. 4 is a perspective view of a section of prior O-gauge Super "O"™ model railroad track commercialized by Lionel Corporation.

Corresponding reference characters indicate corresponding parts throughout the several views. Although the drawings represent an embodiment of the disclosed apparatus, system and/or method, the drawings are not necessarily to scale or to the same scale and certain features may be exaggerated in order to better illustrate and explain the present disclosure. Moreover, in accompanying drawings that show sectional views, cross-hatching of various sectional elements may have been omitted for clarity. It is to be understood that any omission of cross-hatching is for the purpose of clarity in illustration only.

DETAILED DESCRIPTION OF EXEMPLARY EMBODIMENTS

The embodiments of the present disclosure are not intended to be exhaustive or to limit the invention to the precise forms or steps disclosed in the following detailed description, but have been chosen and are herein described so that others skilled in the art may appreciate and understand principles and practices according to the present disclosure. It is, therefore, to be understood that the invention herein described is not limited in its application to the details of construction and the arrangement of components or steps set forth in the following description or illustrated in the drawings, and is capable of having other embodiments and of being practiced or of being carried out in various ways.

Figure 5:
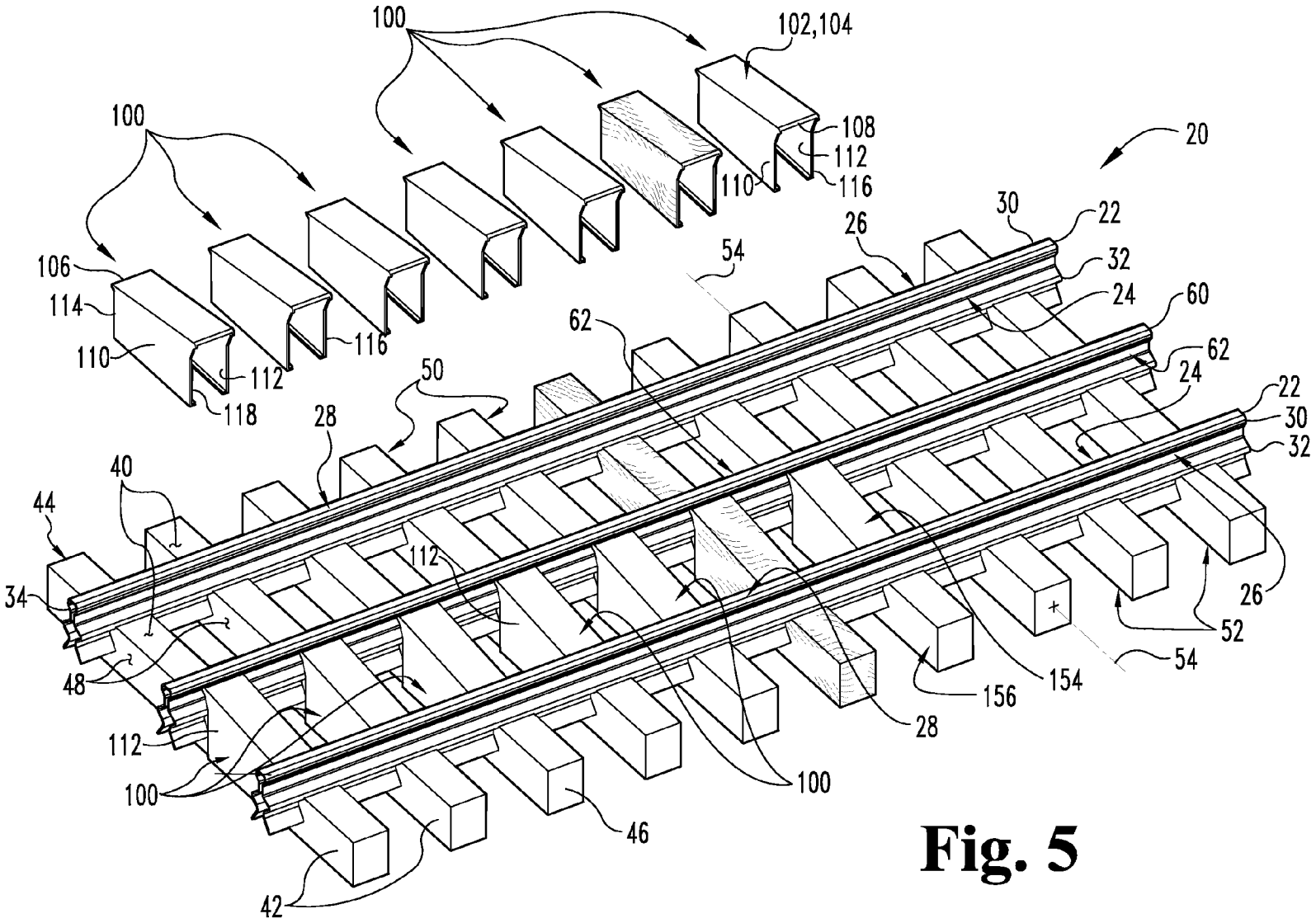
FIG. 5 is an exploded perspective view of a section of extant model railroad track and a plurality of first embodiment inserts according to the present disclosure.

FIG. 5 shows a plurality of aesthetic insert 100 according to a first embodiment in which each insert 100 is an individual, unitary insert element separate from other insert elements. Each insert element 100 is individually received between a wheel bearing rail 22 and the center rail 60 of an extant railroad track section 20. Regardless of the embodiment being discussed, the accompanying drawings show insert installation relative to above-mentioned track section 20*c*, but this particular type of track is to be understood as being merely one example of several types (e.g., track sections 20*a*, 20*b*, 20*c*) having a center rail 60 which is partially hidden or camouflaged by the installed aesthetic insert to make it less noticeable impart a higher degree of realism to the appearance of the track.

Figure 6A:
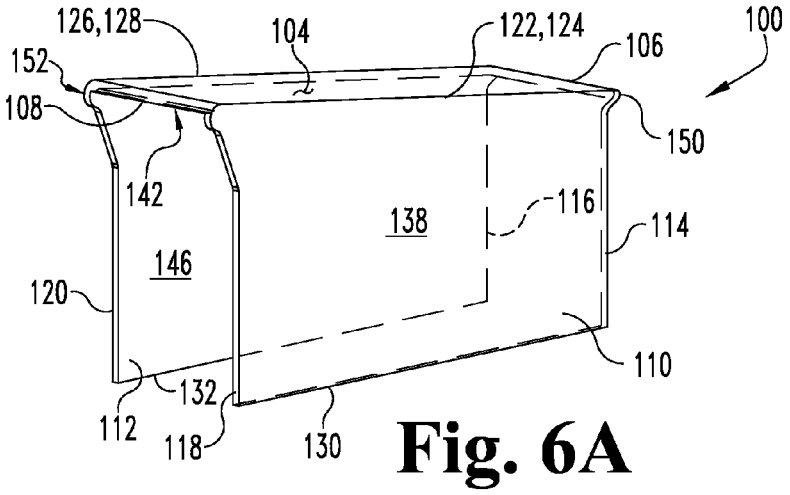
FIG. 6A is a perspective view of a first embodiment insert according to the present disclosure.
Figure 6B:
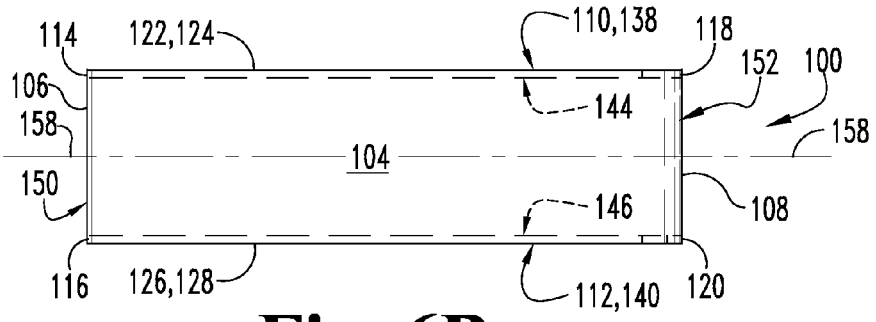
FIG. 6B is a top view of the insert shown in FIG. 6A.
Figure 6C:
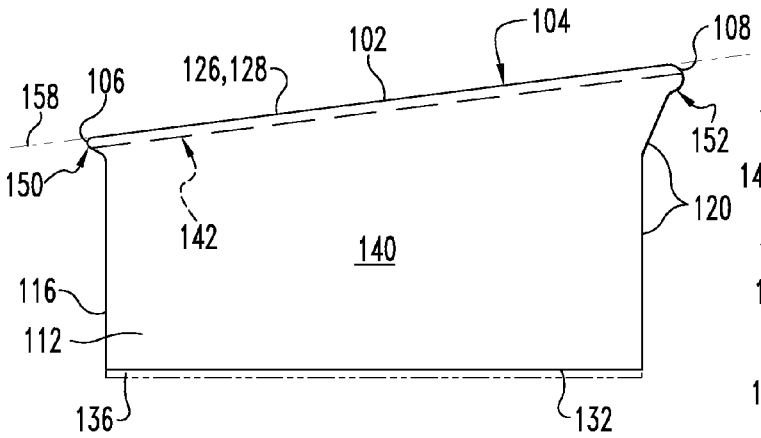
FIG. 6C is a side view of the insert shown in FIG. 6A.
Figure 6D:
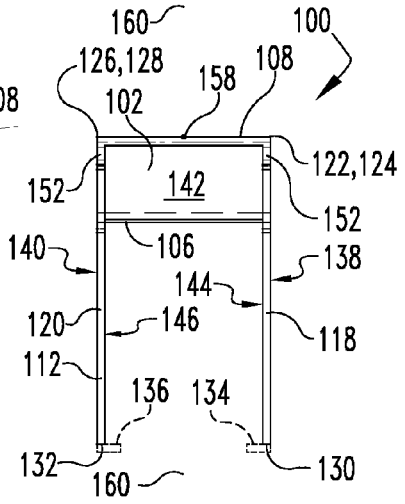
FIG. 6D is an inner end view of the insert shown in FIG. 6A.

Referring to FIGS. 6A-6D, each first embodiment insert 100 has an upper portion or upper panel 102 defining generally planar upper surface or exterior surface 104 that superposes top surface 40 of crosstie 42 between the interfacing lateral sides 24, 62 of a wheel-bearing rail 22 and center rail 60. Upper portion 102 of each insert element 100 has outer edge 106 and inner edge 108 which, in the installed position of insert 100, are disposed adjacent to inwardly-facing lateral side 24 of wheel-bearing rail 22 and superposing outwardly-facing lateral side 62 of center rail 60. Planar upper surface 104 is substantially rectangular and provided with bifurcating central axis 158 extending through outer and inner edges 106, 108, as best seen in FIG. 6B. Axis 158 defines and extends along imaginary plane 160 about which insert element 100 is substantially symmetrical, as best seen in FIG. 6D. In the installed position of insert 100, central axis 54 of the crosstie 42 partially covered thereby becomes positioned coextensively with plane 160.

Each insert 100 has first side portion or first side panel 110 and second side portion or second panel 112. First and second side portions 110, 112 are substantially parallel and, in the installed position, each superposes first side surface 48 or second side surface 50 of the superposed crosstie 42, depending on which lateral side of center rail 60 insert 100 is installed.

Insert element first side panel 110 has outer edge 114 and insert element second side panel 112 has outer edge 116 that is substantially parallel with outer edge 114. Insert element first side panel 110 has inner edge 118 and insert element second side panel 112 has inner edge 120 that is substantially parallel with inner edge 118. Insert element first side panel 110 has top edge 122 that is contiguous with first side edge 124 of insert upper portion 102. Insert element second side panel 112 has top edge 126 that is contiguous with second side edge 128 of insert upper portion 102. The junctures between edges 122 and 124, and the juncture between edges 126 and 128 are substantially linear and parallel.

Figure 7A:
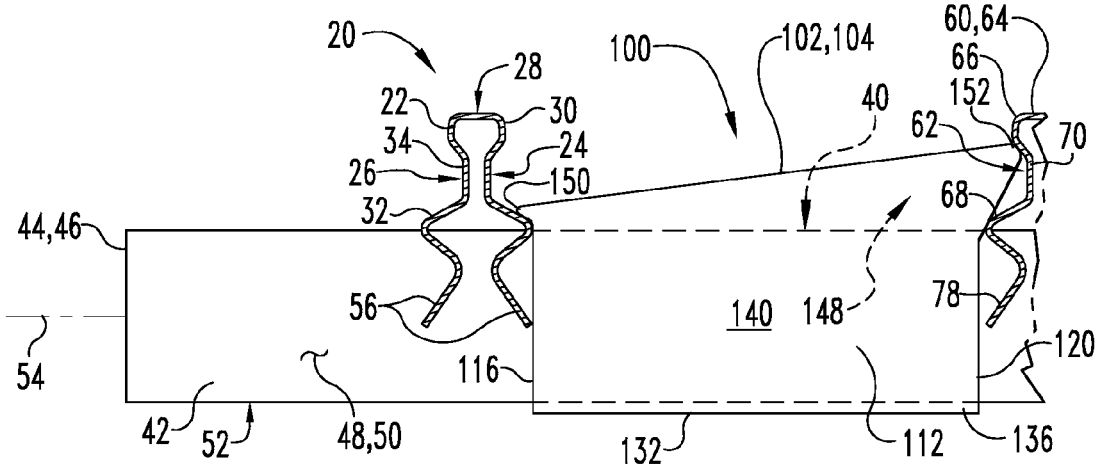
FIG. 7A is a fragmented side view of a first embodiment insert shown in the installed position relative to a section of extant model railroad track.
Figure 7B:
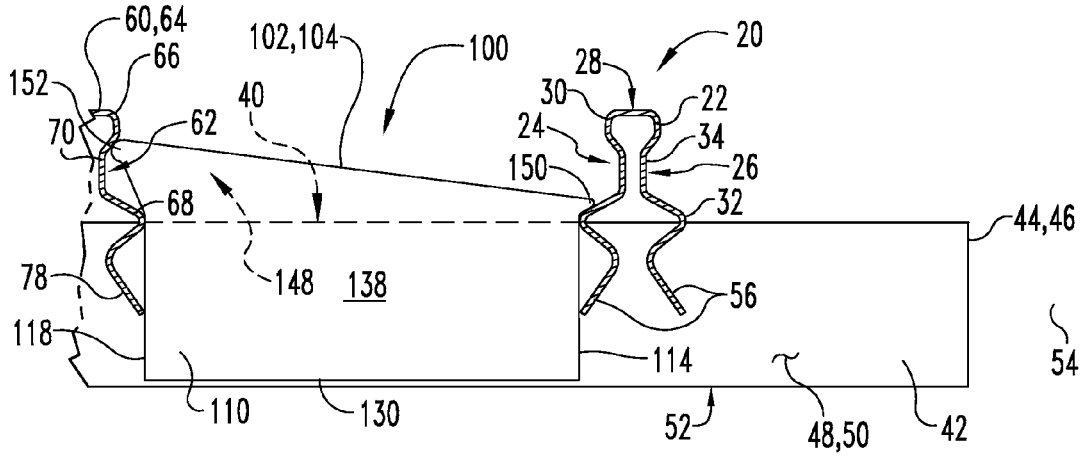
FIG. 7B is a fragmented opposite side view of a variation of a first embodiment insert shown in the installed position relative to a section of extant model railroad track.

Insert element first side panel 110 has bottom edge 130, and insert element second side panel 112 has bottom edge 132. Bottom edges 130 and 132 are substantially parallel. Referring to FIGS. 6C, 6D and 7A, bottom edges 130 and 132 may be provided with lips 134 and 136, respectively, which extend towards each other and are adapted to superpose portions of crosstie bottom surface 52 in the installed position. Lips 134, 136 thus define a retention feature by which insert 100 is retained in its installed position through the abutment engagement between lips 134, 136 and crosstie bottom surface 52. Alternatively, bottom edges 130, 132 may be located along their respective adjacent crosstie side surface 48, 50 in the installed position, as shown in FIG. 7B, with insert 100 retained through frictional engagement between its side panels 110, 112 and the crosstie surfaces 48, 50 superposed thereby. In some embodiments, bottom edges 130, 132 may superposingly abut cross tie top surface 40 in the installed position. Insert 100 may also be bonded in place relative to its respective crosstie 42 with a suitable adhesive.

Insert element 100 may be molded of an elastically deformable plastic material, as by, for example, an injection molding process. Insert element upper portion 102 and first and second side portions 110, 112 are integrally formed. Insert elements 100 may be molded as a plurality of elements interconnected by runners of an injection molded part, and which are separated from each other subsequent to the molding process. The molded material may be of a color substantially matching that of the crossties 42 of a particular brand and size (e.g., O-gauge) of extant track 20. Alternatively, inserts 100 may be painted or dyed to substantially match the crosstie color. First and second side panels 110, 112 respectively define exterior surfaces 138, 140, and insert exterior surfaces 104, 138 and 140 may be provided with a texture 154 substantially matching the texture 156 of crosstie surfaces 40, 48 and 50, as indicated in FIG. 5. Thus, not only the presence of a crosstie surface, but the appearance of a crosstie surface, may be simulated by insert 100.

Lower or interior surface of insert element upper panel 102 defines lower or interior surface 142, and insert element first and second side panels 110, 112 respectively define interior surfaces 144, 146. Referring to FIGS. 7A and 7B, in the installed position surfaces 142, 144 and 146 of insert 100, and the portion of crosstie top surface 40 superposed by insert 100, define enclosed, wedge-shaped space 148.

Outer edges 106, 114 and 116, and inner edges 108, 118 and 120, of insert element 100 may be configured to respectively define outer retention feature 150 and inner retention feature 152 adapted to engage the respective, adjacent one of interfacing rail lateral sides 24 and 62 in the installed position, as shown in FIGS. 7A and/or 7B. Retention features 150 and 152 may be variously configured to best engage and retain insert 100 to rails 22, 60 depending on the particular brand and size (e.g., O-gauge) of extant track 20 associated with a particular variant of the insert. Retention of insert 100 in its installed position may also be accomplished by use of a suitable adhesive, as mentioned above, or through engagement between surfaces of the superposed crosstie 42 and insert element side panels 110, 112 and/or lips 134, 136 that may be provided along their bottom edges 130, 132.

Figure 7C:
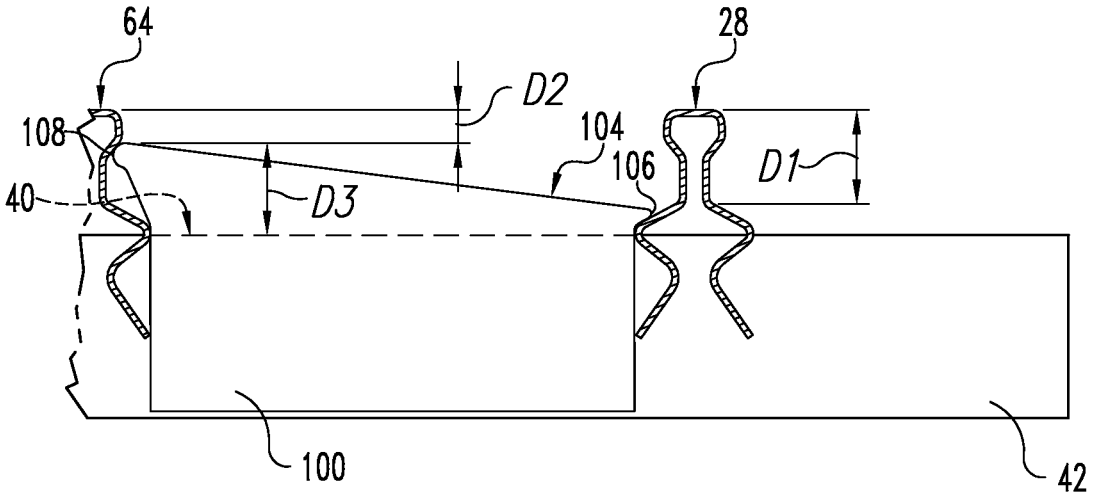
FIG. 7C is a view similar to FIG. 7B, showing distances between portions of the insert and the track.

Referring to FIG. 7C, it can be seen that in the installed position, outer edge 106 of insert element 100, located proximate inward lateral side 24 of wheel-bearing rail 22, is located at distance D1 below the generally horizontal plane defined by rail top surfaces 28 and 64, and that inner edge 108 of insert element 100, located proximate interfacing lateral side 62 of center rail 60, is located at distance D2 below that plane, with distance D1 substantially greater than distance D2. Consequently, lateral side 62 of center rail 60 is partially hidden from view by insert element 100 in the installed position, with inner edge 108 of insert element 100 located at distance D3 above planar top surface 40 of crosstie 42. Distance D3 is preferably substantially greater than distance D2, whereby a greater portion of center rail lateral side 62 is hidden than is visible within the width of insert element 100 between its opposing exterior surfaces 138 and 140. Furthermore, distance D1 is sufficiently below wheel-bearing rail top surface 28 so as not to interfere with the flanges of train wheels, which extend below wheel-bearing rail top surface 28 and travel along inward lateral side 24 of each rail 22. Moreover, distance D2 is sufficiently below center rail top surface 64 so as not to interfere with the electrical connection between the locomotive's electrical contact (not shown) that engages top surface 64 of powered center rail 60, typically by sliding therealong as the train moves along track 20.

Figure 8:
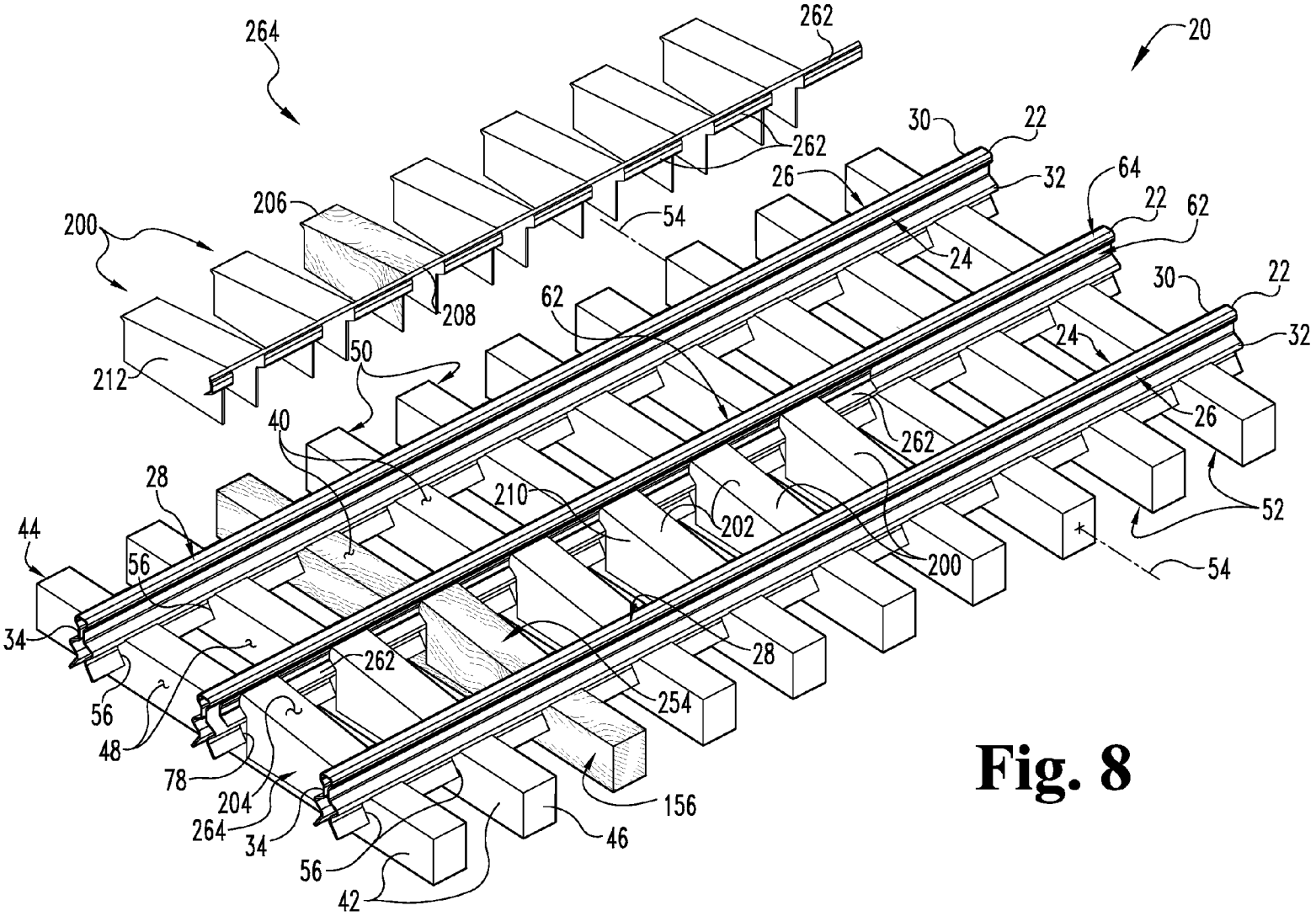
FIG. 8 is an exploded perspective view of a section of extant model railroad track and a plurality of second embodiment inserts according to the present disclosure.

FIG. 8 shows an insert including plurality of interconnected aesthetic insert elements 200 according to a second embodiment in which each insert element 200 has a configuration similar to an above-described insert element 100. Each adjacent pair of insert elements 200 is interconnected by a connecting member 262, whereby the plurality of insert elements 200 and their interconnecting connecting member(s) 262 define aesthetic insert 264 that is received between a wheel bearing rail 22 and the center rail 60 of an extant railroad track section 20. Except where noted or clear from its context in view of the Figures, it is to be understood that the following description of an insert element 200 relates to each respective one of the interconnected plurality of insert elements 200 in insert 264.

Figure 9A:
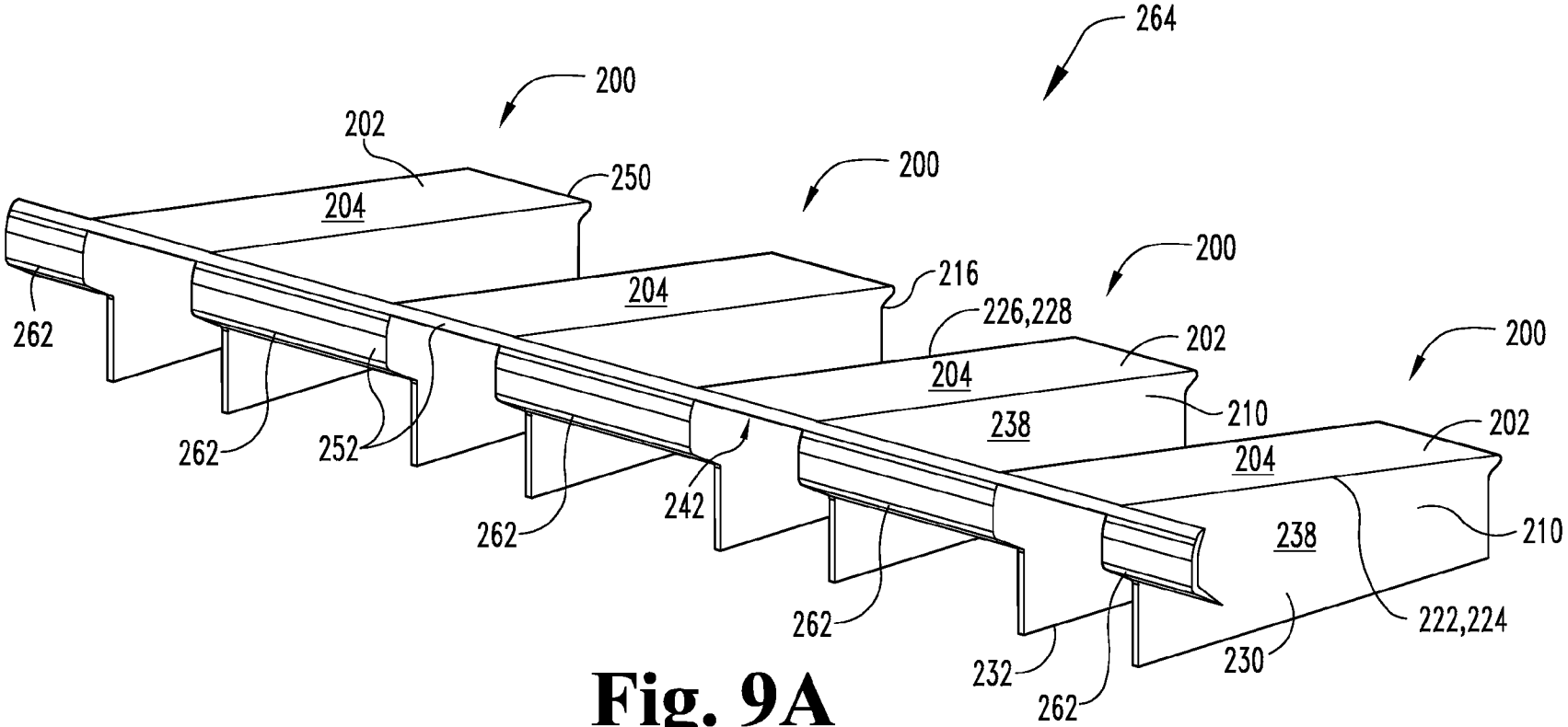
FIG. 9A is a perspective view of a second embodiment insert according to the present disclosure.
Figure 9B:
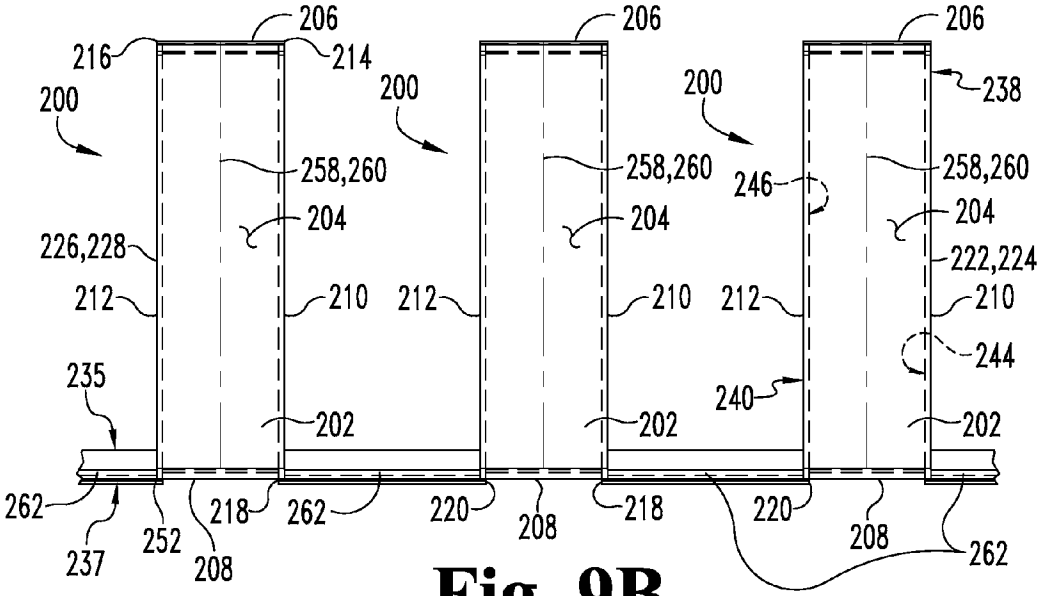
FIG. 9B is a top view of the insert shown in FIG. 9A.
Figure 9C:
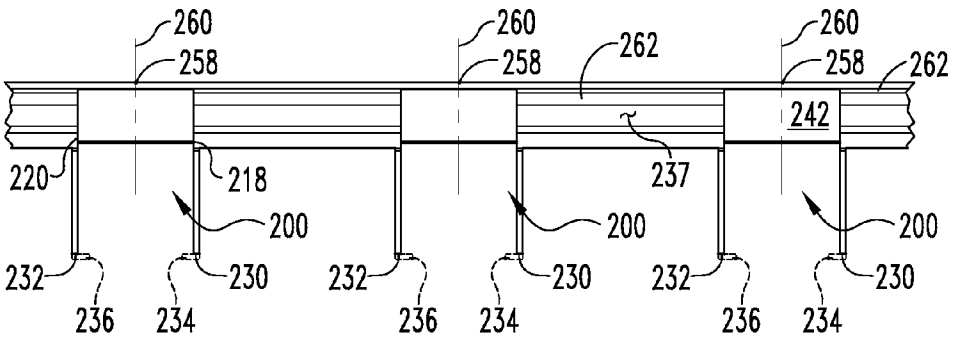
FIG. 9C is an inner end view of the insert shown in FIG. 9A.

Referring to FIGS. 9A-9D, each second embodiment insert element 200 has an upper portion or upper panel 202 defining generally planar upper surface or exterior surface 204 that superposes top surface 40 of crosstie 42 between the interfacing lateral sides 24, 62 of a wheel-bearing rail 22 and center rail 60. Upper portion 202 of each insert element 200 has outer edge 206 and inner edge 208 which, in the installed position of the interconnected plurality of insert elements 200, are disposed adjacent to inwardly-facing lateral side 24 of wheel-bearing rail 22 and superposing outwardly-facing lateral side 62 of center rail 60. Each planar upper surface 204 is substantially rectangular and provided with bifurcating central axis 258 extending through outer and inner edges 206, 208, as best seen in FIG. 9B. Each axis 258 defines and extends along an imaginary plane 260 about which the respective insert element 200 is substantially symmetrical, as best seen in FIG. 9C. In the installed position of the plurality of interconnected insert elements 200, central axes 54 of the crossties 42 partially covered thereby become positioned coextensively with plane 260.

Each insert element 200 has first side portion or first side panel 210 and second side portion or second panel 212. First and second side portions 210, 212 are substantially parallel and, in the installed position, each superposes first side surface 48 or second side surface 50 of its respective superposed crosstie 42, depending on which lateral side of center rail 60 the plurality of interconnected insert elements 200 is installed.

Each insert element first side panel 210 has outer edge 214 and insert element second side panel 212 has outer edge 216 that is substantially parallel with outer edge 214. Insert element first side panel 210 has inner edge 218 and insert element second side panel 212 has inner edge 220 that is substantially parallel with inner edge 218. As best shown in FIGS. 9A and 9B, each connecting member 262 is elongate and ribbon-like, having opposing outer surface 235 and inner surface 237. Connecting member 262 is integrally connected at its opposite ends to the to insert element side portions 210, 212, with connecting member inner surface 237 coextensive with insert element side portion inner edges 218, 220. Insert element first side panel 210 has top edge 222 that is contiguous with first side edge 224 of insert upper portion 202. Insert element second side panel 212 has top edge 226 that is contiguous with second side edge 228 of insert upper portion 202. The junctures between edges 222 and 224, and the juncture between edges 226 and 228 are substantially linear and parallel.

Figure 10A:
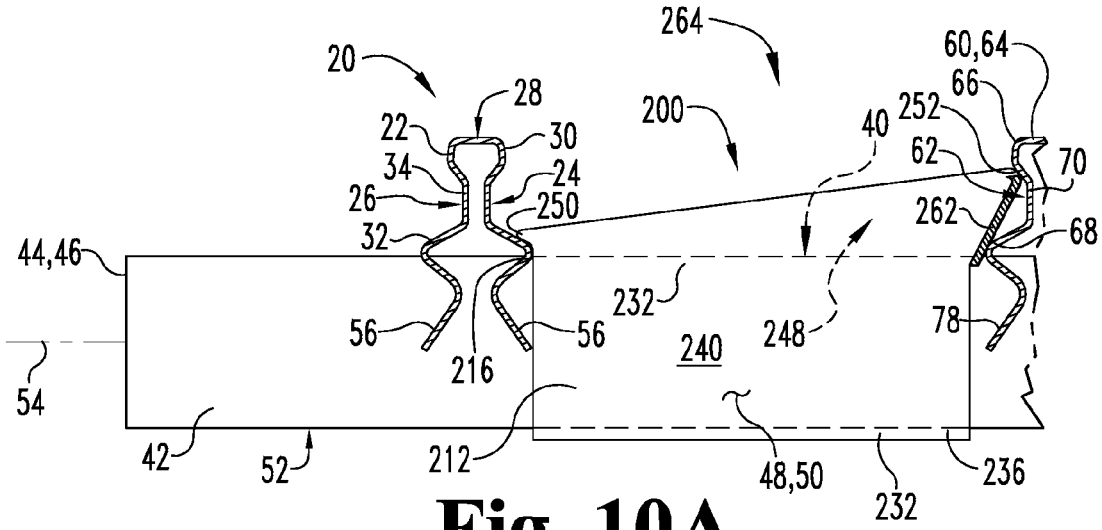
FIG. 10A is a fragmented side view of a second embodiment insert shown in the installed position relative to a section of extant model railroad track.
Figure 10B:
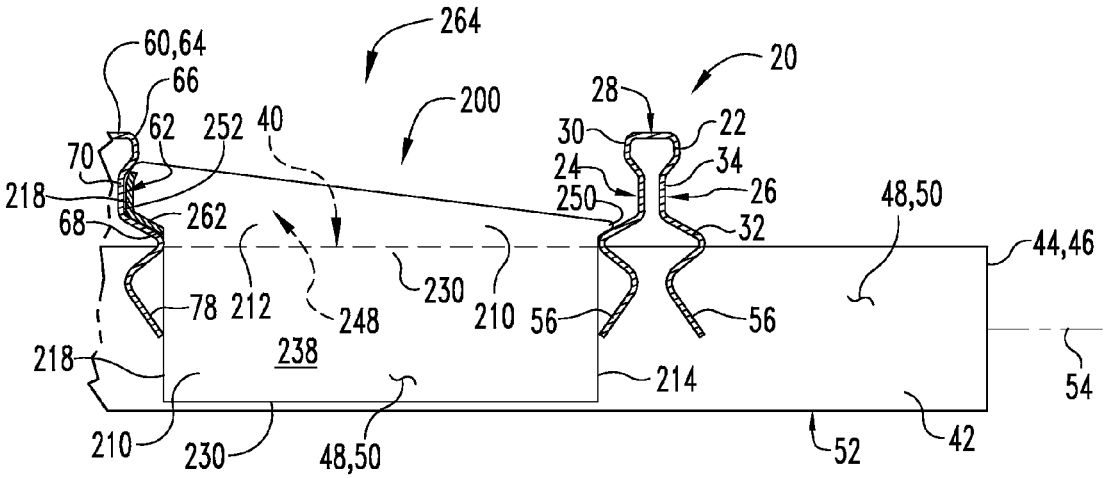
FIG. 10B is a fragmented opposite side view of a variation of a first embodiment insert shown in the installed position relative to a section of extant model railroad track.
Figure 9D:
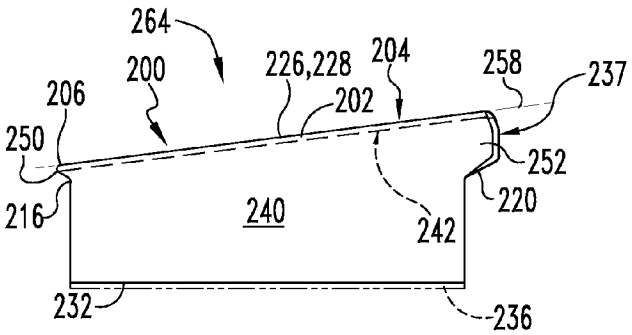
FIG. 9D is a side view of the insert shown in FIG. 9A.

Each insert element first side panel 210 has bottom edge 230, and each insert element second side panel 212 has bottom edge 232. Bottom edges 230 and 232 are substantially parallel. Referring to FIGS. 9C, 9D, and 10A, bottom edges 130 and 132 may be provided with lips 234 and 236, respectively, which extend towards each other and are adapted to superpose portions of crosstie bottom surface 52 in the installed position. Lips 234, 236 thus define a retention feature by which each insert element 200 is retained in its installed position through the abutment engagement between the lips and crosstie bottom surface 52. Alternatively, bottom edges 230, 232 may be located along their respective adjacent crosstie side surface 48, 50 in the installed position, as shown in FIG. 10B, with insert element 200 retained through frictional engagement between its side panels 210, 212 and the crosstie surfaces 48, 50 superposed thereby. In some embodiments, bottom edges 230, 232 may superposingly abut cross tie top surface 40 in the installed position. Insert element 200 may also be bonded in place relative to its respective crosstie 42 with a suitable adhesive. Further, inner surface 237 of connecting member(s) 262 may be similarly bonded to the respective center rail lateral side 62 abutted thereby.

The interconnected plurality of insert elements 200 and interconnecting member(s) 262 may be molded of an elastically deformable plastic material, as by, for example, an injection molding process. The insert upper portion 202 and first and second side portions 210, 212 of each insert element 200, and the connecting member(s) 262 are integrally formed. Inserts 264 may be molded as a plurality of elements 200 and connecting members 262 interconnected by runners of an injection molded part, with each insert 264 separated from another subsequent to the molding process. The molded material may be of a color substantially matching that of the crossties 42 of a particular brand of extant track 20. Alternatively, the interconnected plurality of insert elements 200 may be painted or dyed to substantially match the crosstie color. First and second side panels 210, 212 respectively define exterior surfaces 238, 240, and insert exterior surfaces 204, 238 and 240 may be provided with a texture 254 substantially matching the texture 156 of crosstie surfaces 40, 48 and 50, as indicated in FIG. 8. Thus, not only the presence of a crosstie surface, but the appearance of a crosstie surface, may be simulated by insert 264.

Lower or interior surface of each insert element upper panel 202 defines lower or interior surface 242, and insert element first and second side panels 210, 212 respectively define interior surfaces 244, 246. Referring to FIGS. 10A and 10B, in the installed position surfaces 242, 244 and 246 of each insert element 200, and the portion of respective crosstie top surface 40 superposed by that insert element 200, define enclosed, wedge-shaped space 248.

Outer edges 206, 214 and 216, and inner edges 208, 218 and 220, of each insert element 200 may be configured to respectively define outer retention feature 250 and inner retention feature 252 adapted to engage the respective, adjacent one of interfacing rail lateral sides 24 and 62 in the installed position, as shown in FIGS. 10A and/or 10B. Additionally, inner surface 237 of each connecting member 262 may be configured to define inner retention feature 252. Retention features 250 and 252 may be variously configured to best engage and retain insert 264 to rails 22, 60 depending on the particular brand and size (e.g., O-gauge) of extant track 20 associated with a particular variant of the insert. Retention of insert 264 in its installed position may also be accomplished by use of a suitable adhesive, as mentioned above, or through engagement between surfaces of the superposed crosstie 42 and insert element side panels 210, 212 and/or lips 234, 236 that may be provided along their bottom edges 230, 232.

Figure 11:
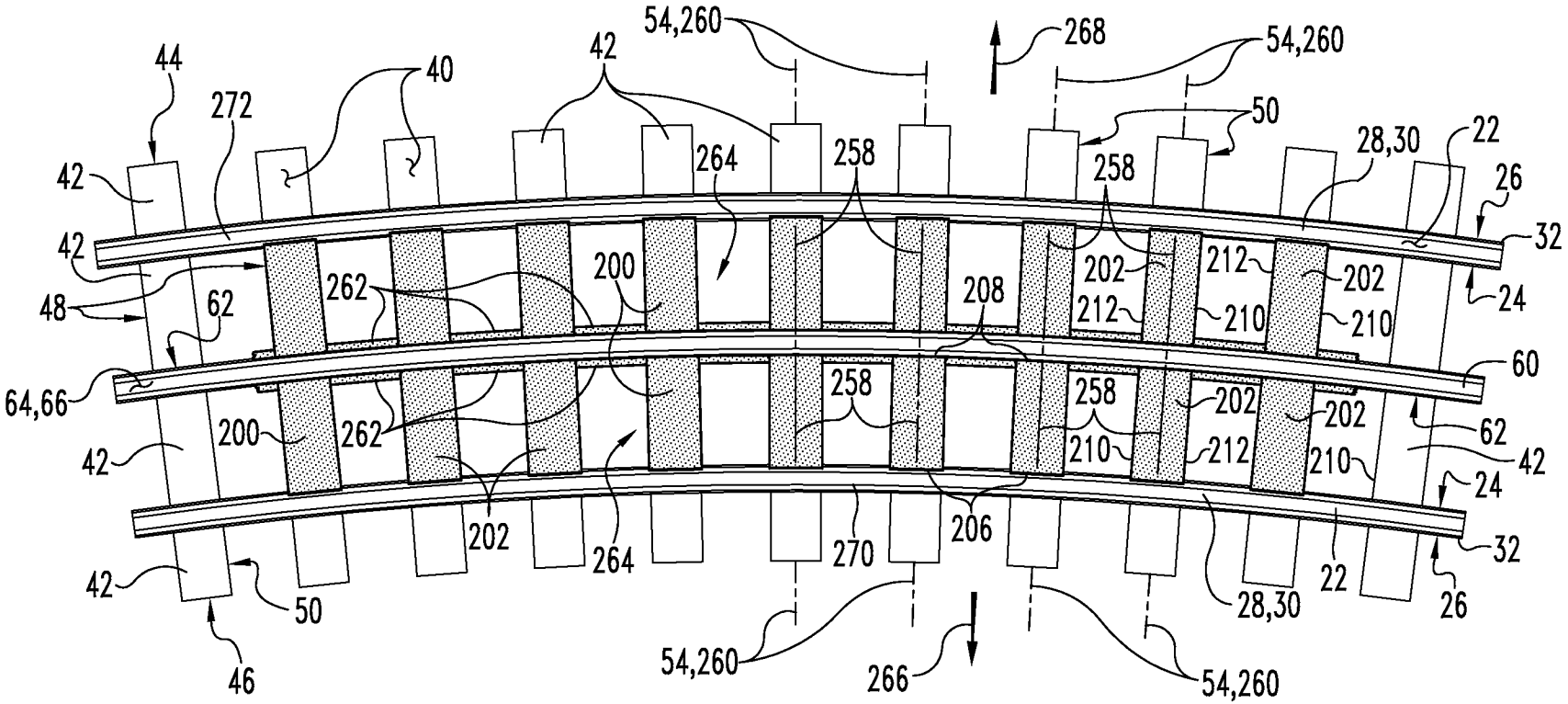
FIG. 11 is a plan view of a curved section of extant railroad track and a pair of second embodiment inserts in their installed positions on laterally opposite sides of the central rail, the inserts shown shaded for clarity.

Connecting member(s) 262 is flexible, and conforms to the curvature of interfacing center rail lateral side 62. Referring to FIG. 11, which shows a curved extant railroad track section 20, insert 264 may have an installed position in which it is received between center rail 60 and the wheel bearing rail 22, 270 disposed at the inside of the curve, indicated by radially-directed arrow 266. Insert 264 may also have an installed position in which it is received between center rail 60 and the wheel bearing rail 22, 272 disposed at the outside of the curve, indicated by radially-directed arrow 268. With insert 264 installed between center rail 60 and wheel-bearing rail 270, above-mentioned planes 260 thereof converge in the direction of arrow 266. With insert 264 installed between center rail 60 and wheel-bearing rail 272, above-mentioned planes 260 thereof diverge in the direction of arrow 268.

Figure 10C:
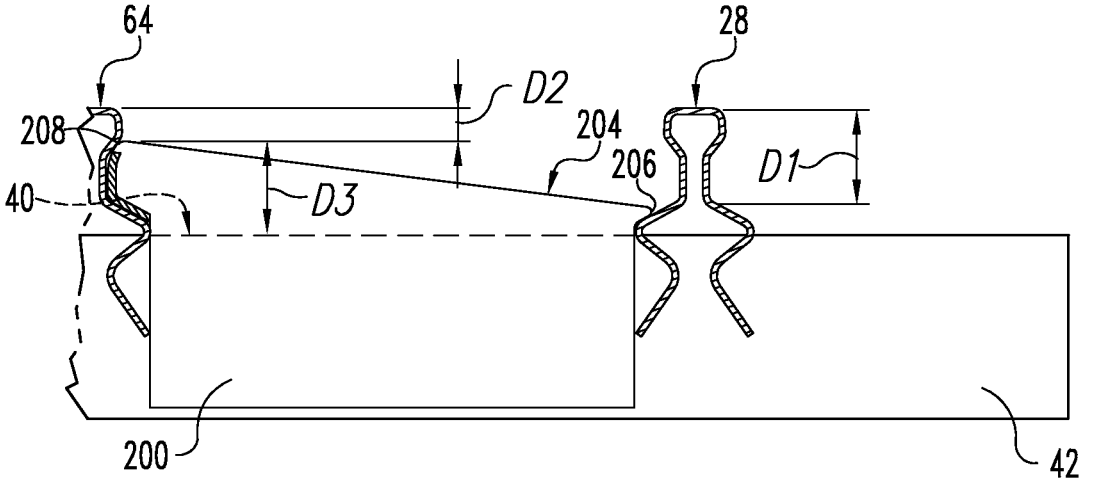
FIG. 10C is a view similar to FIG. 10B, showing distances between portions of the insert and the track.

Referring to FIG. 10C, it can be seen that in the installed position, outer edge 206 of insert element 200, located proximate inward lateral side 24 of wheel-bearing rail 22, is located at distance D1 below the generally horizontal plane defined by rail top surfaces 28 and 64, and that inner edge 208 of insert element 200, located proximate interfacing lateral side 62 of center rail 60, is located at distance D2 below that plane, with distance D1 substantially greater than distance D2. Consequently, lateral side 62 of center rail 60 is partially hidden from view by insert element 200 in the installed position, with inner edge 208 of insert element 200 located at distance D3 above planar top surface 40 of crosstie 42. Distance D3 is preferably substantially greater than distance D2, whereby a greater portion of center rail lateral side 62 is hidden than is visible within the width of insert element 200 between its opposing exterior surfaces 238 and 240. Furthermore, distance D1 is sufficiently below wheel-bearing rail top surface 28 so as not to interfere with the flanges of train wheels, which extend below wheel-bearing rail top surface 28 and travel along inward lateral side 24 of each rail 22. Moreover, distance D2 is sufficiently below center rail top surface 64 so as not to interfere with the electrical connection between the locomotive's electrical contact (not shown) that engages top surface 64 of powered center rail 60, typically by sliding therealong as the train moves along track 20.

While exemplary embodiments have been disclosed hereinabove, the invention is not necessarily limited to the disclosed embodiments. Instead, this application is intended to cover any variations, uses, or adaptations of the present disclosure using its general principles. Further, this application is intended to cover such departures from the present disclosure as come within known or customary practice in the art to which this present disclosure pertains and which fall within the limits of the appended claims.

What is claimed is:

1. An aesthetic insert for use with extant model railroad track having spaced, elongate and parallel first and second rails each having a top surface, the first and second rails having mutually interfacing sides, the extant model railroad track also having a plurality of spaced crossties extending between and at least partially located beneath the attached first and second rails, each of the plurality of crossties having a top surface located between the first and second rails, the sides of the first and second rails having a substantially common height from the top surface of the crosstie to the respective top surfaces of the first and second rails, said insert having an installed position relative to the extant model railroad track between the first and second rails, said insert comprising:

an insert element defined by an upper portion adapted to superpose at least a portion of the top surface of a crosstie, said upper portion having an upper surface adapted to simulate the presence and/or appearance of a surface of a crosstie, said upper portion defining an outer edge located proximate the side of the first rail at a first distance below the top surface of the first rail in said installed position, said upper portion defining an inner edge located proximate the side of the second rail at a second distance below the top surface of the second rail in said installed position, said first distance substantially greater than said second distance, whereby the side of the second rail is partially hidden from view by said insert in said installed position.

2. The insert of claim 1, wherein said outer and inner edges are substantially parallel.

3. The insert of claim 1, wherein, in said installed position, said second distance is substantially less than a third distance to said inner edge above the top surface of the crosstie superposed by said upper portion.

4. The insert of claim 1, wherein said upper portion upper surface is substantially planar.

5. The insert of claim 1, further comprising spaced first and second side portions depending from said upper portion, said side portions adapted to at least partially enclose a space located between said upper portion and the top surface of the crosstie superposed by said upper portion in said installed position.

6. The insert of claim 5, wherein said first and second side portions and said upper portion are integrally-formed of molded dielectric material.

7. The insert of claim 5, wherein said first and second side portions are adapted to superpose portions of opposing surfaces of a crosstie in said installed position.

8. The insert of claim 5, wherein said first and second side portions are substantially planar.

9. The insert of claim 5, wherein said first and second side portions define a pair of opposing exterior side surfaces each adapted to simulate the presence and/or appearance of a surface of a crosstie.

10. The insert of claim 1, wherein said insert comprises an interconnected plurality of insert elements, each insert element having a said upper portion adapted to superpose a different one of the plurality of crossties in said installed position.

11. The insert of claim 10, wherein said plurality of insert elements is interconnected proximate the side of the second rail in said installed position.

12. The insert of claim 10, further comprising a connecting member extending between two said insert elements, said connecting member disposed proximate said inner edges of the respective insert elements and extending along the side of the second rail in said installed position.

13. The insert of claim 12, wherein said connection member is flexible and the two said insert elements are adapted to have different orientations relative to each other in said installed position.

14. The insert of claim 10, wherein each said upper portion is elongate and is bisected by a plane extending between the respective outer and inner edges, each said insert element substantially symmetrical about the respective plane thereof.

15. The insert of claim 14, wherein said insert is adapted to be received between the first and second rails of a section of extant model railroad track;

wherein relative to a received said insert in the installed position the planes of an adjacent pair of the respective insert elements are substantially parallel along a straight section of the extant model railroad track, and/or converge in a direction from the respective outer edges to the respective inner edges along a curved section of the extant model railroad track whose first rail defines an outside curve, and/or diverge in a direction from the respective outer edges to the respective inner edges along a curved section of the extant model railroad track whose first rail defines an inside curve.

16. The insert of claim 1, wherein said insert is adapted to retentively engage at least one surface of a superposed crosstie in said installed position.

17. The insert of claim 1, wherein said insert is adapted to retentively engage opposing surfaces of a superposed crosstie in said installed position.

18. The insert of claim 1, wherein said insert is adapted to retentively engage a bottom surface of a superposed crosstie in said installed position.

19. The insert of claim 18, wherein said insert element comprises spaced first and second side portions depending from said upper portion, said first and second side portions adapted to superpose portions of opposing surfaces of a crosstie in said installed position, and provided with lips adapted to superpose a bottom surface of a superposed crosstie in said installed position.

20. The insert of claim 1, wherein said insert is adapted to retentively engage at least one of the first and second rails in said installed position.

* * * * *